US005706877A

United States Patent [19]

Grisham et al.

[11] Patent Number: 5,706,877

[45] Date of Patent: Jan. 13, 1998

[54] LOCKING AND REINFORCING MECHANISM FOR GARAGE DOOR

[75] Inventors: James L. Grisham, Denison; David Scott Boucher, Rowlett, both of Tex.

[73] Assignee: Overhead Door Corporation, Dallas, Tex.

[21] Appl. No.: 584,177

[22] Filed: Jan. 11, 1996

[51] Int. Cl.[6] ..... E05D 15/16

[52] U.S. Cl. ..... 160/201; 160/234; 292/DIG. 36

[58] Field of Search ..... 160/201, 234, 160/209, 199, 206; 292/183, 189, 194, 202, 150; 52/457

[56] References Cited

U.S. PATENT DOCUMENTS

| | | | |
|---|---|---|---|
| 1,364,749 | 1/1921 | Graybeal | 292/150 |
| 1,474,675 | 11/1923 | Kirkness | 160/234 X |
| 2,240,416 | 4/1941 | Pidgeon | 156/23 |
| 2,678,689 | 5/1954 | McKee et al. | 160/201 |
| 2,786,523 | 3/1957 | Phillips | 160/201 X |
| 3,104,699 | 9/1963 | Wolf et al. | 160/10 |
| 3,176,757 | 4/1965 | Lomaz | 160/209 |
| 3,853,166 | 12/1974 | Wrono | 160/133 |
| 3,891,021 | 6/1975 | Geoffrey | 160/201 X |
| 4,443,033 | 4/1984 | D'Anna | 292/DIG. 36 |
| 4,618,177 | 10/1986 | Schultz | 160/201 X |
| 5,046,544 | 9/1991 | Coluccio | 160/201 |
| 5,445,207 | 8/1995 | Romanelli et al. | 160/209 |

FOREIGN PATENT DOCUMENTS

| | | | |
|---|---|---|---|
| 1238828 | 7/1971 | United Kingdom | 292/189 |

OTHER PUBLICATIONS

The Storm Bar Brochure (best available copy) date unknown.

Stanley Door Systems Brochure (best available copy) Jun., 1994.

*Primary Examiner*—Blair Johnson

*Attorney, Agent, or Firm*—Akin, Gump, Strauss, Hauer & Feld, L.L.P.

[57] ABSTRACT

Vertically opening sectional doors, such as residential garage doors, are reinforced against high wind loads in their closed positions by a set of reinforcing and locking pin receiving tubes supported on each sectional panel and aligned with each other. Each receiving tube supports a door reinforcing pin or bolt in a retracted position by a removable retaining pin. The retaining pins may be released to allow the reinforcing pins to partially extend from one tube into an adjacent tube on an adjacent door section to prevent pivotal movement of door sections relative to each other. A top wall bracket adjacent the upper horizontal edge of the door includes a member engageable with the door edge and a pair of links connected to one of the pin receiving tubes to retain the top edge of the door from displacement away from the door opening and to prevent opening movement of the door during high wind loads imposed thereon. The lowermost pin support tube includes a pin operable to extend from the lower edge of the door into a recess formed in the building floor to lock the bottom edge of the door against displacement away from the door opening. The door locking and reinforcing mechanism may be provided as original equipment on new doors, or as a kit for retrofitting existing doors.

13 Claims, 9 Drawing Sheets

LOCKING AND REINFORCING MECHANISM FOR GARAGE DOOR

BACKGROUND OF THE INVENTION

1. Field of the Invention

The present invention pertains to a sectional door, such as a garage door, which includes a plurality of retractable locking and reinforcing pins or bolts extending between adjacent hinged door sections to reinforce the door against high wind loads.

2. Background

Sectional type doors are widely used for covering relatively large openings in buildings, such as residential garages. A typical sectional door comprises a plurality of elongated sections or panels, adjacent ones of which are hinged to each other and are supported at their opposite transverse ends on guidetracks to provide for moving the door from a generally vertical closed position to an open position disposed above the garage floor. The substantial size of such doors, including each section or panel, augurs in favor of making each section as light in weight as possible while retaining adequate strength. Moreover, the adjacent support structure of the building for supporting the door and its guidetracks must also be taken into consideration in minimizing door weight.

However, sectional hinged doors can be somewhat susceptible to being torn from their supporting structure or being folded in one direction or the other under forces exerted by very high wind loads sometimes encountered during adverse weather conditions. Such winds can cause pressure forces tending to push the door from its support structure into the building, or a pressure differential may be caused to exist, at least momentarily, which forces the door outwardly with each section tending to be folded with respect to its adjacent sections. In both conditions forces can be exerted on the door which lead to catastrophic failure. Since maximum door weight must be taken into account when considering reinforcement structure for resisting high wind loads, providing conventional bracing, increased wall thickness of the door panels or larger hinges does not receive favorable consideration because of the weight added to the door itself. In any case, the hinged panels or sections still tend to be folded in their normal direction of operation under conditions where atmospheric pressure inside a building is greater than outside in the vicinity of the door. Accordingly, a reinforcing mechanism to minimize the chance of door collapse or displacement from the door opening during high wind conditions should be characterized in that it does not add an appreciable amount of weight to the door itself, is capable of being rapidly and easily placed in use only on occasions when high wind load conditions are to be encountered, such as the approach of major storm fronts or hurricane force winds, for example, and can be easily deactivated to allow normal operation of the door.

The increasing frequency of major storms and other adverse weather conditions encountered in various geographical areas and changes in regulations and building codes by governmental authorities has given rise to the desire and necessity of providing a door reinforcing or anti-collapse mechanism which may be easily included in newly manufactured doors without major door design changes and retrofitted to existing doors. Such a mechanism should be relatively low in cost, easy to ship, not add a substantial amount of weight to the door and be capable of installation without a substantial amount of training or instruction by installation personnel or by the door owner, such as a residential home owner.

Those skilled in the art will appreciate that there has been a significant need for a door reinforcing mechanism which meets the desiderata mentioned above. It is to these ends that the present invention has been developed.

SUMMARY OF THE INVENTION

The present invention provides a unique sectional door for covering relatively large openings in buildings, such as garage openings, and having a reinforcing mechanism to minimize the chance of door displacement or collapse during high wind loads imposed on the door.

In accordance with one important aspect of the invention, a door locking and reinforcing mechanism is provided which is operable to minimize the chance of door displacement or collapse by providing for deployment of reinforcing pins or bolts extending between adjacent hinged sections of sectional garage doors and the like to prevent collapse or displacement of the door from its normal working position due to folding of the door sections about their hinged connections. The reinforcing pins or bolts are operable to minimize the chance of the door sections folding in either direction due to wind loads and pressure differential forces acting across the door in either direction due to such wind loads or other adverse atmospheric conditions, for example.

In accordance with another important aspect of the invention, a sectional garage door is provided with a reinforcing mechanism which prevents movement of the sectional door panels about their hinged connections while securing the door to at least one of the floor under the door, an adjacent wall and/or support structure for the door such as the door supporting and guiding tracks at opposite lateral sides thereof.

In accordance with yet another aspect of the present invention, an articulated or sectional type door is provided with a reinforcing and locking mechanism which may be easily installed on new doors at the time of door fabrication or may be retrofitted to existing doors. The door locking and reinforcing mechanism is easy to fabricate and is substantially characterized by conventional mechanical hardware elements which are easily adapted to form the reinforcing and locking mechanism.

Those skilled in the art will further appreciate the abovementioned advantages and superior features of the invention together with other important aspects thereof upon reading the detailed description which follows in conjunction with the drawing.

DESCRIPTION OF PREFERRED EMBODIMENTS

Figure 1:
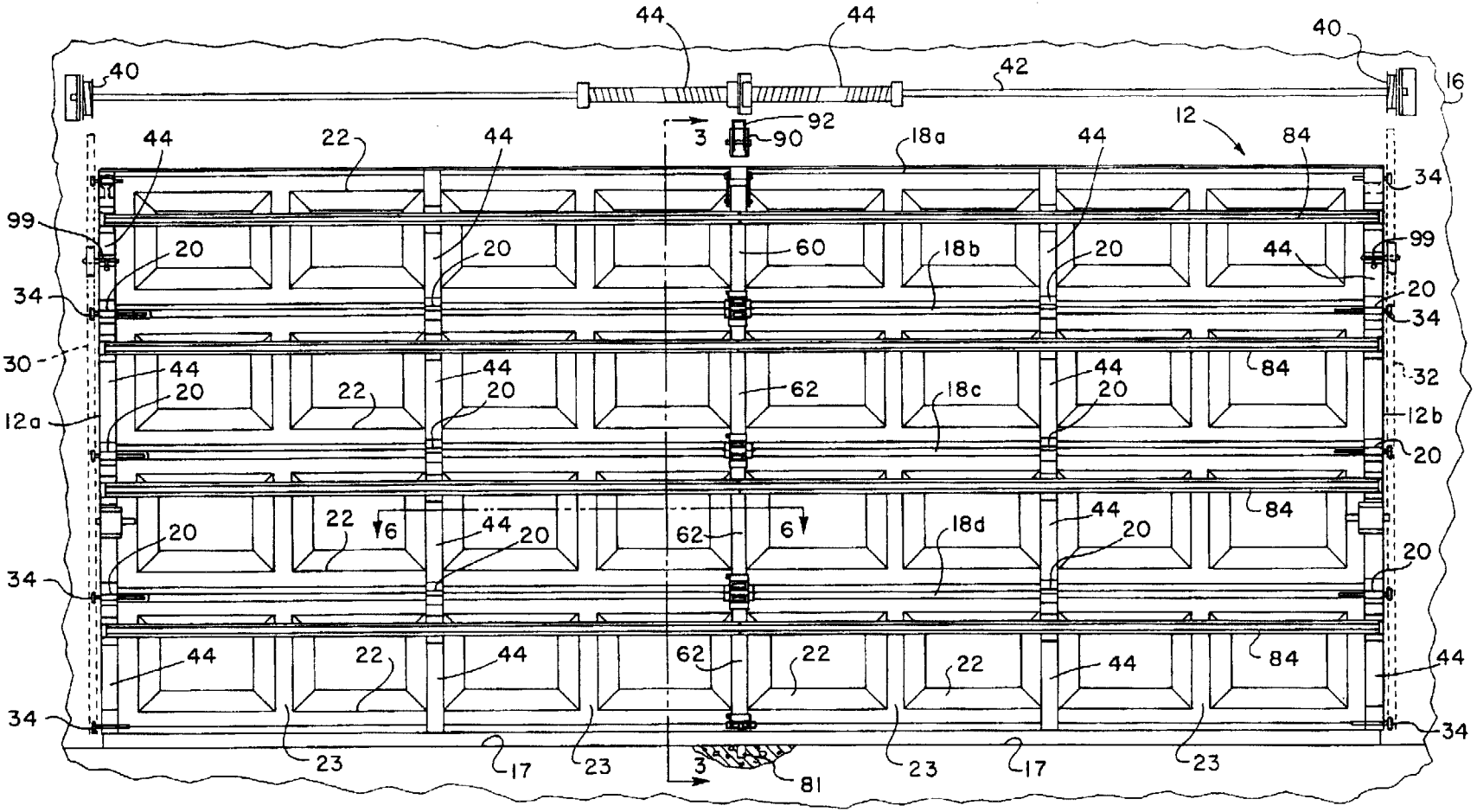
FIG. 1 is a rear elevation of a sectional garage door including the vertical oriented locking and reinforcing mechanism of the present invention.

In the description which follows, like elements are marked throughout the specification and drawing with the same reference numerals, respectively. The drawing figures are not necessarily to scale in the interest of clarity and conciseness.

Figure 2:
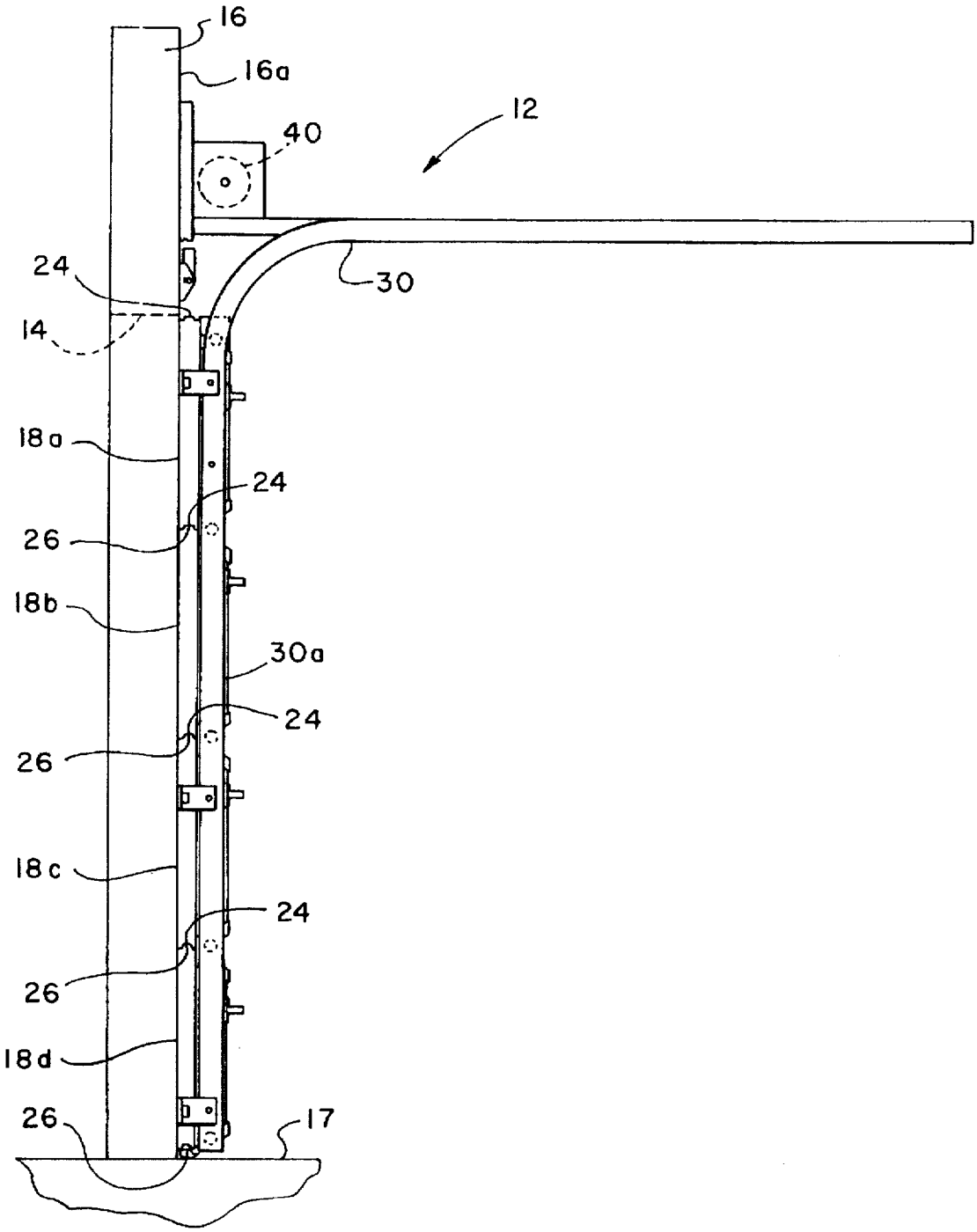
FIG. 2 is a side elevation of the door shown in FIG. 1.

Referring to FIGS. 1 and 2, there is illustrated a generally rectangular, sectional, vertical opening type door, generally designated by the numeral 12. The door 12 is adapted to form a closure for a generally rectangular opening 14, FIG. 2, defined by a vertical wall 16 and floor 17 of a building, such as a residential garage, for example. The door 12 is of substantially conventional construction, except as modified by the present invention, and is typical of vertical opening residential garage doors. However, the door 12 of the present invention may also be utilized in other applications and may have specific design features different from some of the detail features of the door described herein.

The door 12 is made up of a plurality of hinged sections or panels 18*a*, 18*b*, 18*c* and 18*d*. The sections 18*a* and 18*b* are secured together by spaced apart hinges 20. In like manner, the sections 18*b* and 18*c* are hinged together at spaced apart hinges 20 and the sections 18*c* and 18*d* are also hinged together at spaced apart hinges 20. The hinges 20 are connected to each of the sections 18*a*, 18*b*, 18*c* and 18*d* adjacent respective lower and upper generally horizontal edges in a conventional manner. The door sections 18*a*, 18*b*, 18*c* and 18*d* may be substantially identical in construction and comprise a sheet metal or reinforced plastic panel which may be embossed at 22 for aesthetic and stiffening purposes. Each door section 18*a* through 18*d* has elongated, generally horizontally extending upper and lower edges 24 and 26, see FIGS. 2, 3 and 5, which are formed by folding the upper and lower panel ends to form a somewhat tubular box beam shaped configuration.

The door 12 is adapted to be moved from a closed position covering the opening 14 to a substantially open position along opposed guidetracks 30 and 32, FIGS. 1 and 2, supported on wall 16 adjacent the opening 14. Spaced apart guide rollers 34, see FIG. 1, are supported on the respective sections 18*a*, 18*b*, 18*c* and 18*d* and operable to ride in the tracks 30 and 32 in a conventional manner. The door 12 may be moved between open and closed positions by conventional mechanism including opposed flexible cables, not shown, which are wound on respective cable drums 40 supported on the interior surface 16*a* of wall 16 in a conventional manner. The drums 40 are each secured to a suitable shaft 42 and cooperating counterbalance springs 44, also in a conventional manner. The door 12 may be assisted in movement between an open and closed position by power operated mechanism, not shown.

Figure 3:
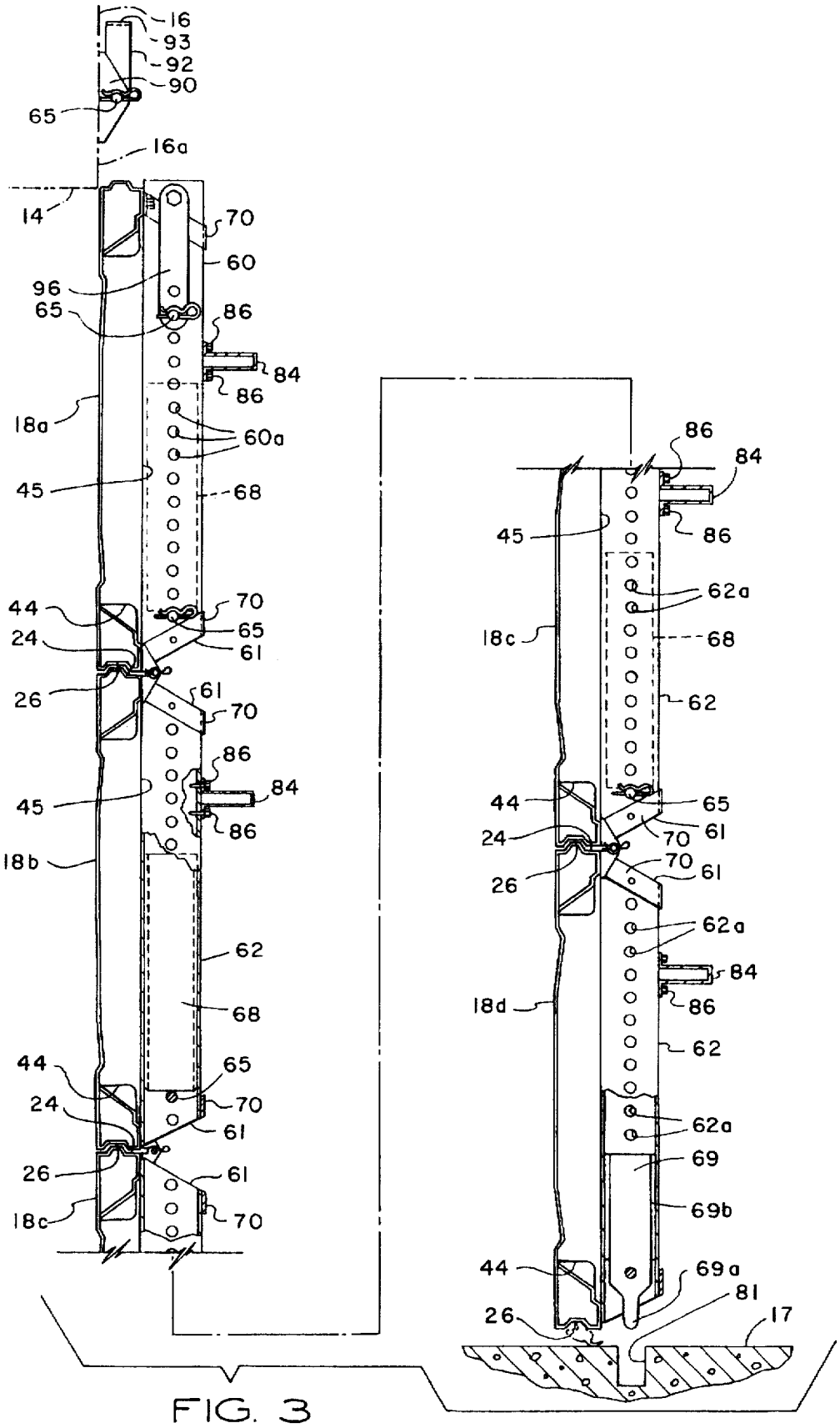
FIG. 3 is a section view taken generally along the line 3—3 of FIG. 1 showing the reinforcing pins in a retracted position for normal operation of the door.
Figure 6:
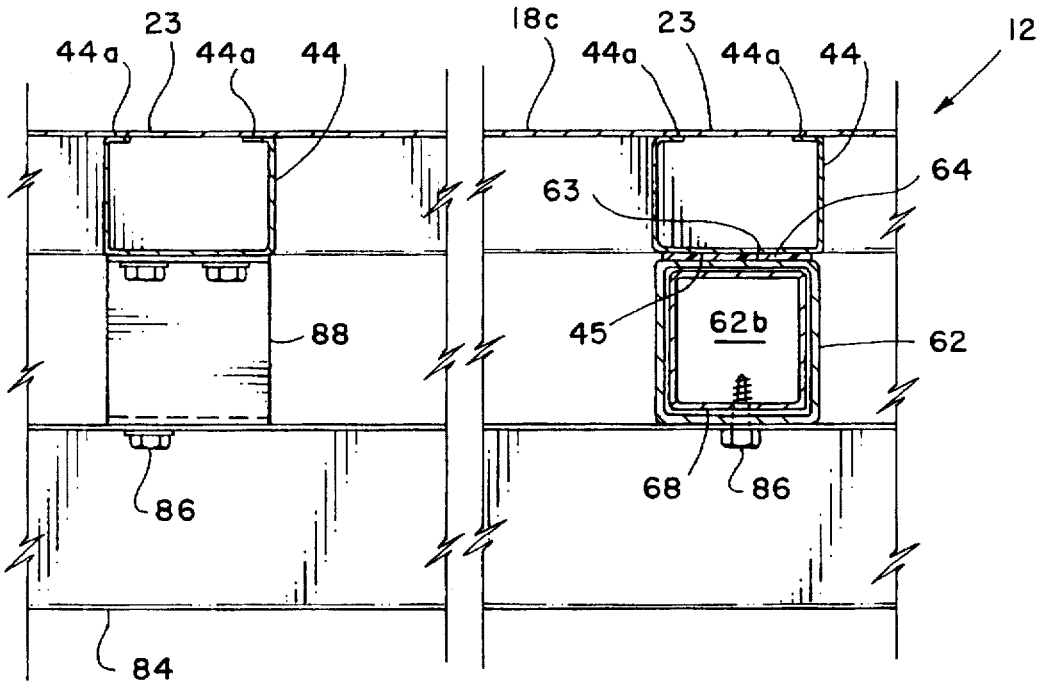
FIG. 6 is a section view taken generally along the line 6—6 of FIG. 1.

Referring further to FIGS. 1, 3 and 6 each of the door sections 18*a* through 18*d* is provided with a plurality of spaced apart strengthening members or stiles 44 which extend between the upper and lower edges 24 and 26 of each panel or section. The stiles 44 may comprise generally rectangular cross section tube members or channel members having opposed flange portions 44*a*, FIG. 6, which are operable to be secured to selected ones of generally flat sheet portions 23 of each door section between the embossed portions 22 thereof, respectively. Alternatively, the door sections 18*a* through 18*d* may be characterized by an inner sheet, not shown, secured to and spaced from the section panels, respectively, and having suitable insulating material interposed therebetween.

The door sections 18*a* through 18*d* are advantageously interconnected by the respective sets of hinges 20 to enable the door to be moved from a closed position extending in a generally vertical plane to an open position extending in a generally horizontal plane supported by and guided by the tracks 30 and 32. Although each door section 18*a*, 18*b*, 18*c* and 18*d* is connected to an adjacent section by the hinges 20 for folding in only one direction and forms a substantially strong closure for the opening 14, extremely high wind loads created by straight line or vortical airflow may generate a pressure differential great enough across the face of the door, in its closed position, to invite catastrophic failure due to the large surface area of the door. For example, conventional residential garage doors may measure seven or eight feet in height and sixteen to eighteen feet in width. Under certain wind conditions, the door may tend to fold about its hinges 20 in one direction or the other depending on the condition where atmospheric pressure inside the building is greater or less than outside the building in the immediate vicinity of the door opening 14. Either condition may be present in adverse weather situations. Moreover, the generally vertically extending portions 30*a*, for example, FIG. 2, of the guidetracks 30 and 32 may extend at a slight angle from the vertical in order to provide for movement of the door away from the wall surface 16*a* when the door is being moved to an open position. This slight inclination of the tracks 30 and 32 and the outer surface of the door 12 will tend to produce a force component acting on the door as a result of horizontal straight line winds, for example, which will tend to move the door to an open position. Accordingly, it has been deemed advantageous, and necessary, to comply with regulatory requirements, to provide a mechanism which will reduce the tendency for the door sections 18*a*, 18*b*, 18*c* and 18*d* to hinge relative to each other, to resist door movement away from the opening 14 under relatively high wind loads acting thereon and to prevent the door from tending to move to an open position as a result of such wind loads.

Figure 4:
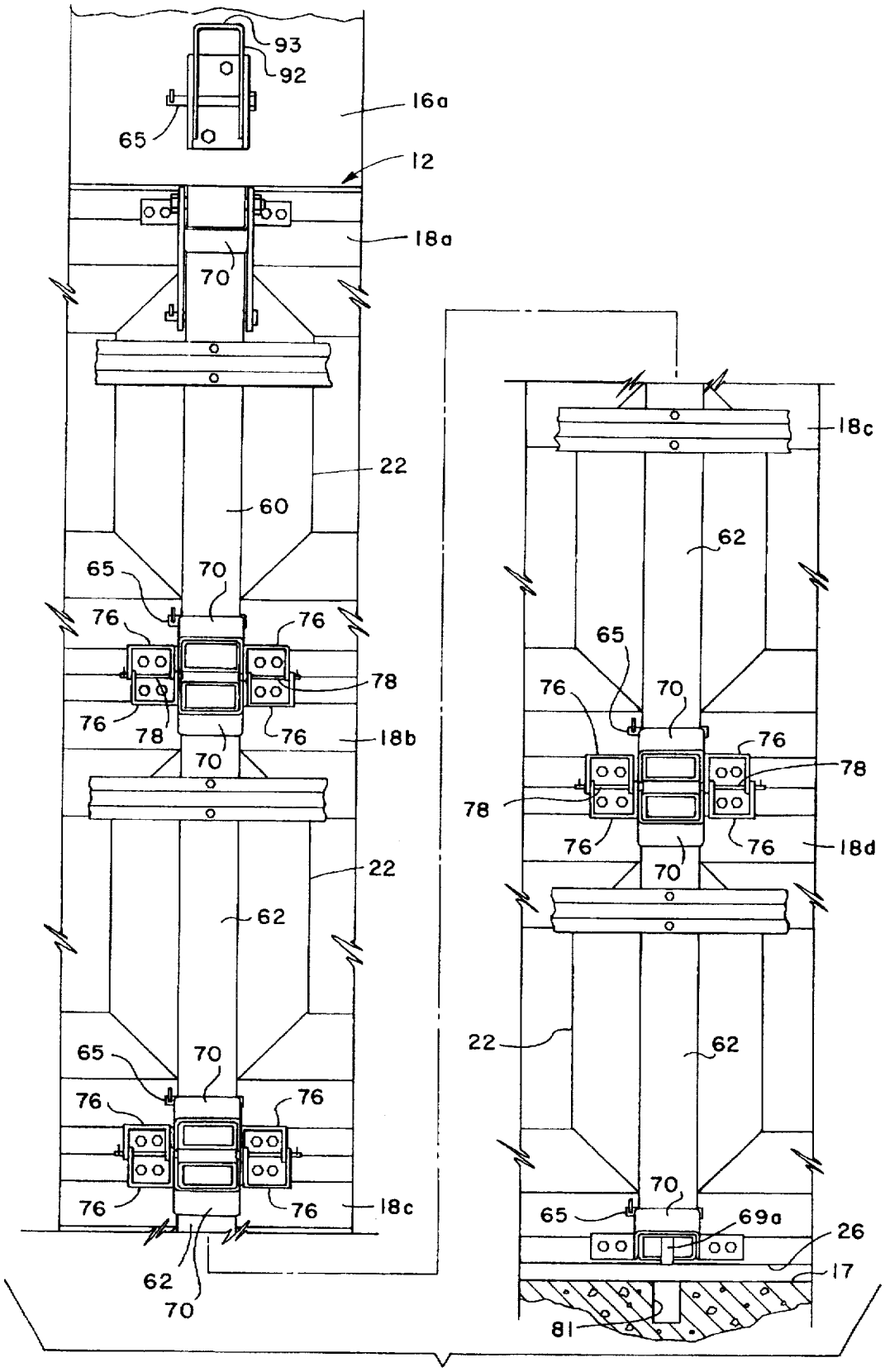
FIG. 4 is a detail elevation of the reinforcing and locking mechanism.

Referring further to FIG. 1 and also to FIGS. 3 and 4, a unique door reinforcing and locking mechanism is provided to prevent pivotal movement of the door sections 18*a*, 18*b*, 18*c* and 18*d* relative to each other about the respective sets of hinges 20 and to prevent movement of the door either vertically or horizontally with respect to the opening 14. The door reinforcing and locking mechanism is preferably characterized by a plurality of vertically spaced apart and aligned tube members 60 and 62 which are mounted on the respective door sections 18*a*, 18*b*, 18*c* and 18*d*. The tubes 60 and 62 are preferably substantially square cross section steel or other suitable metal tubing, see FIG. 6, suitably secured to the center set of stiles 44, by way of example, disposed midway between opposite sides of the door 12. The tubes 60 and 62 are substantially identical except the tubes 62 are scarfed at 61 at both ends to provide clearance for folding or pivotal movement of the door sections 18*a*, 18*b*, 18*c* and 18*d*. A preferred manner of securing the tubes 60 and 62 to the stiles 44 includes a suitable layer of adhesive 64, FIG. 6, between a surface 45 of the stile 44 and a surface 63, for example, of a tube 62. A suitable adhesive for securing the tubes 60 and 62 to their respective stiles 44 may be a toluene based adhesive sold under the trademark Silaprene by the Uniroyal Division of the Michelin Corporation.

Figure 7:
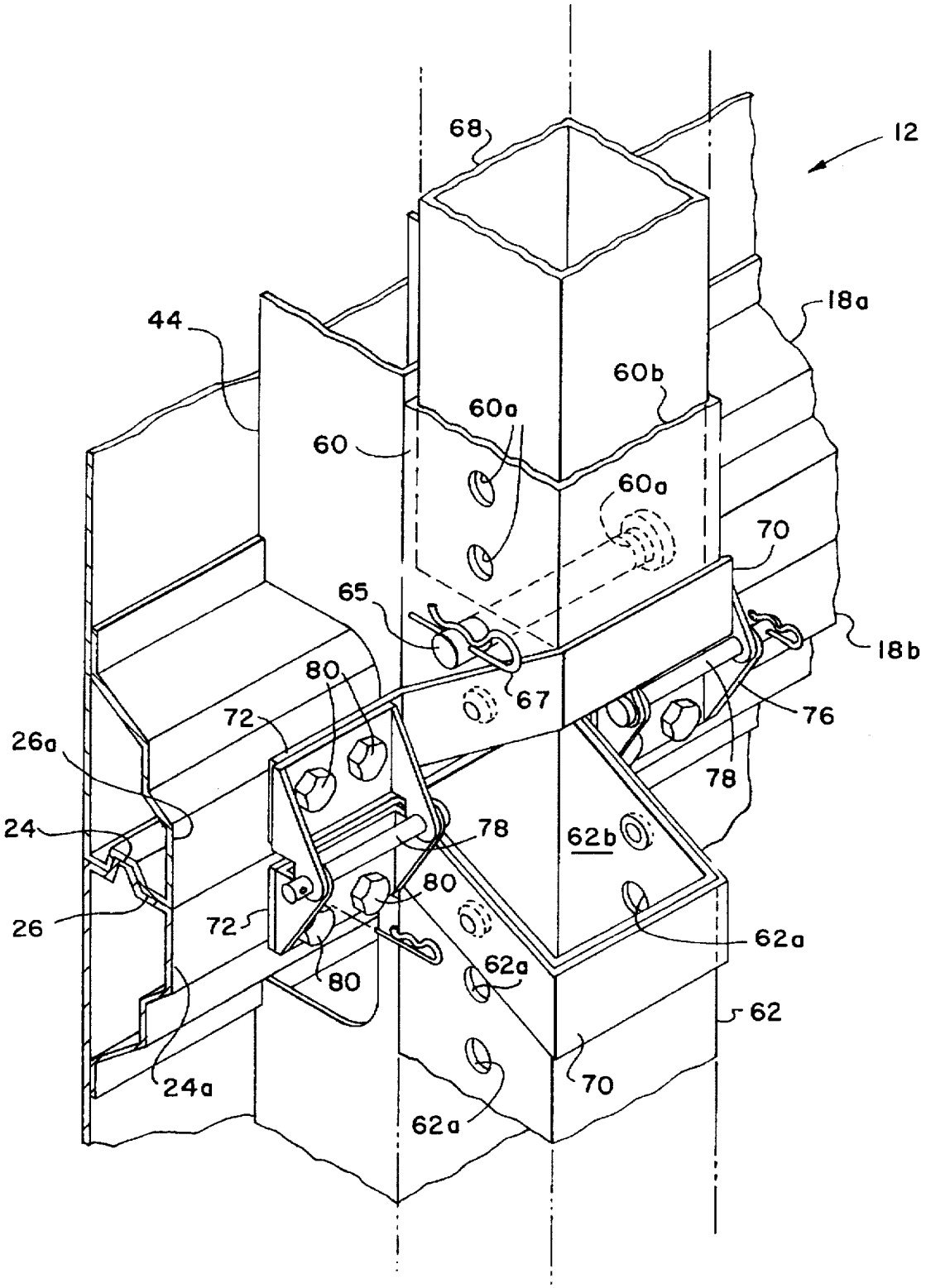
FIG. 7 is a detail perspective view showing a preferred arrangement of support brackets and door hinges at the juncture of adjacent reinforcing pin receiving and support tubes.

The tubes 60 and 62 are also secured to the door sections 18*a*, 18*b*, 18*c* and 18*d* by spaced apart somewhat U-shaped brackets 70, see FIGS. 3, 4, 5 and 7, having opposed flanges 72 which are contiguous with surfaces 24*a* and 26*a*, for example, of the edges 24 and 26 of each of the panels or sections 18*a*, 18*b*, 18*c* and 18*d*. The flanges 72 are disposed under respective hinge brackets 76, FIG. 7, of hinge sets for the adjacent sections of the door 12 and which are suitably aligned with the hinges 20. The hinge brackets 76 are generally U-shaped members, each provided with suitable opposed flanges for supporting a hinge pin 78, as shown in FIGS. 3, 4 and 7. Accordingly, the tubes 60 and 62 are each secured to the door sections 18*a*, 18*b*, 18*c* and 18*d* by the aforementioned adhesive layer and also by the opposed brackets 70 which are secured to the respective door sections along with the hinge brackets 76 by suitable threaded fasteners 80, FIGS. 3, 4 and 7. The fasteners 80 may, for example, be conventional, hexhead, self-tapping sheet metal screws or the like.

Referring further to FIGS. 3 and 7, each of the tubes 60 and 62 has a series of opposed spaced apart pin receiving holes 60*a* and 62*a* formed therein, respectively. The sets of holes 60*a* and 62*a* are provided for receiving suitable removable retaining pins 65 in each of the tubes 60 and 62, as shown in FIGS. 3, 4 and 7, which pins are retained in their working position by a removable hairpin type retainers 67 of a conventional design. The pins 65 are typically disposed near the lower end of each of the tubes 60 and 62 for retaining therewithin, respective elongated door locking and reinforcing pins 68. The reinforcing pins 68 are preferably hollow tubular members themselves, see FIG. 6, and dimensioned to be slidably fitted within each of the receiving members formed by the tubes 60 and 62 and secured therein in retracted positions as shown in FIG. 3 by the respective retaining pins 65. As shown in FIG. 3, the lowermost tube 62, supported on the door section 18*d* is adapted to retain an anchor pin 69 therein in a retracted position, as shown, and retained by one of the retaining pins 65. The anchor pin 69 has a projecting portion 69*a* which is operable to be disposed in a suitable pin receiving recess or hole 81 formed in the floor 17.

Referring further to FIGS. 1, 3 and 4, the door 12 is preferably also provided with strengthening members comprising elongated, somewhat U-shaped struts or rails 84 extending across the door sections 18*a*, 18*b*, 18*c* and 18*d*, respectively, as shown in FIG. 1, and suitably secured to the tubes 60 and 62, as shown in FIG. 3, by self tapping threaded fasteners 86. The struts 84 are also secured to the door sections 18*a*, 18*b*, 18*c* and 18*d*, respectively, at spaced apart points by suitable standoff members 88, see FIG. 6, to accommodate the space between the struts 84 and the respective stiles 44 disposed on either side of the center stiles, due to the spacing created by the tubes 60 and 62. As shown in FIGS. 1 and 3, the struts 84 are disposed somewhat off center between the opposite ends of the tubes 60 and 62, respectively, and are positioned a short distance from the upper end of each of the tubes. The fasteners 86 are of sufficient length to project through the wall of each tube 60 and 62 and into the interior receptacle space 60*b* and 62*b* thereof, respectively.

Figure 8:
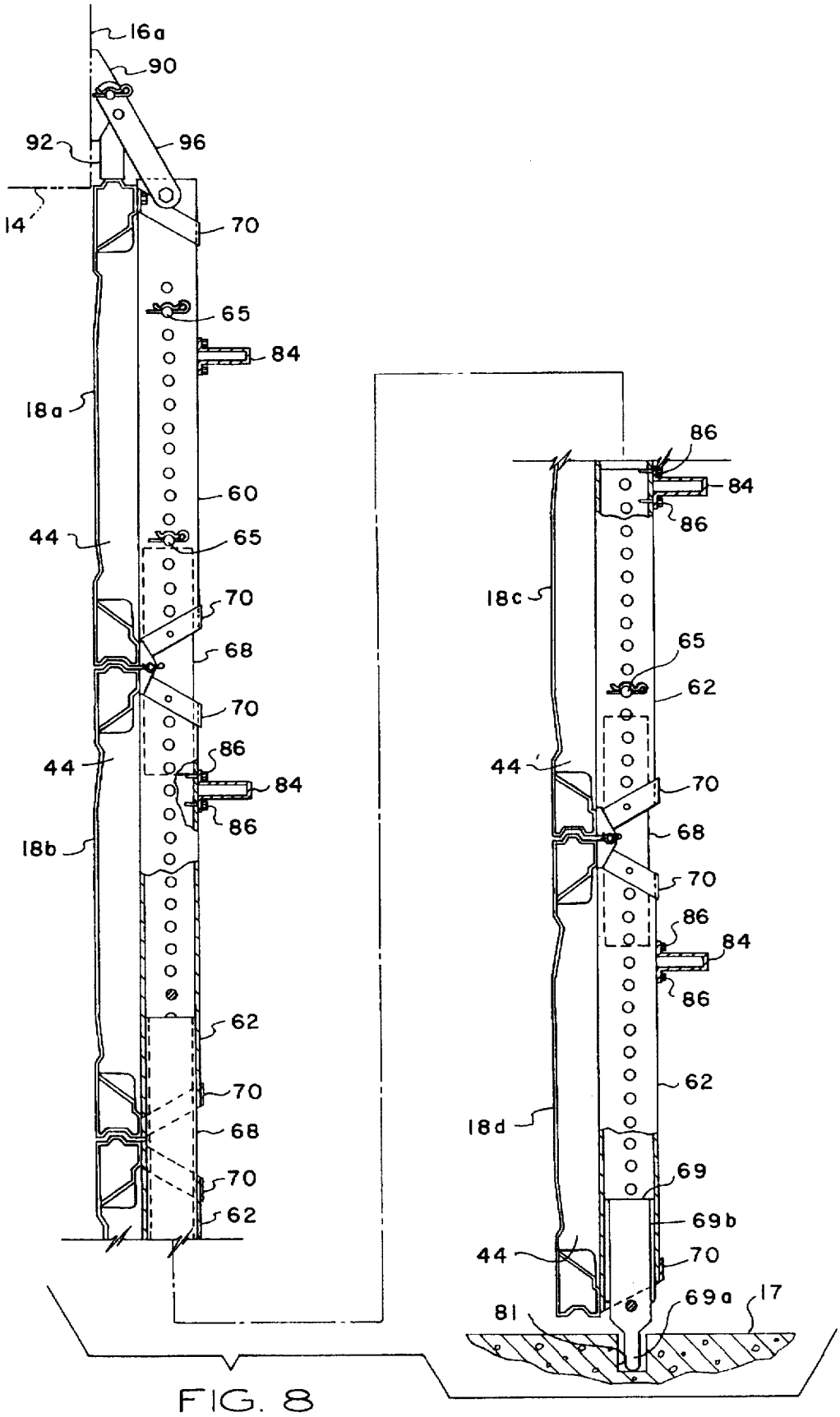
FIG. 8 is a section view similar to FIG. 3 showing the locking and reinforcing pins in a locked position of the door.

When the door 12 is disposed in a generally vertical position, as shown in FIGS. 1 and 3, for example, the sections 18*a*, 18*b*, 18*c* and 18*d* are substantially coplanar and the tubes 60 and 62 are also vertically aligned with each other in such a way that, upon removal of the respective retaining pins 65, each reinforcing pin 68 may be dropped partially down from its support tube, respectively, and into the receptacle 62*b* provided by the adjacent tube 62 therebelow to form a lock to prevent the adjacent door sections from pivoting with respect to each other, see FIG. 8. Moreover, the anchor pin 69 may be dropped into a position where the portion 69*a* projects into the hole 81 in the floor 17 upon removal of the retaining pin 65 from the anchor pin and its support tube 62. Of course, a shank portion 69*b* of the anchor pin 69 is retained substantially within the tube 62 in supportive relationship thereto.

Figure 5:
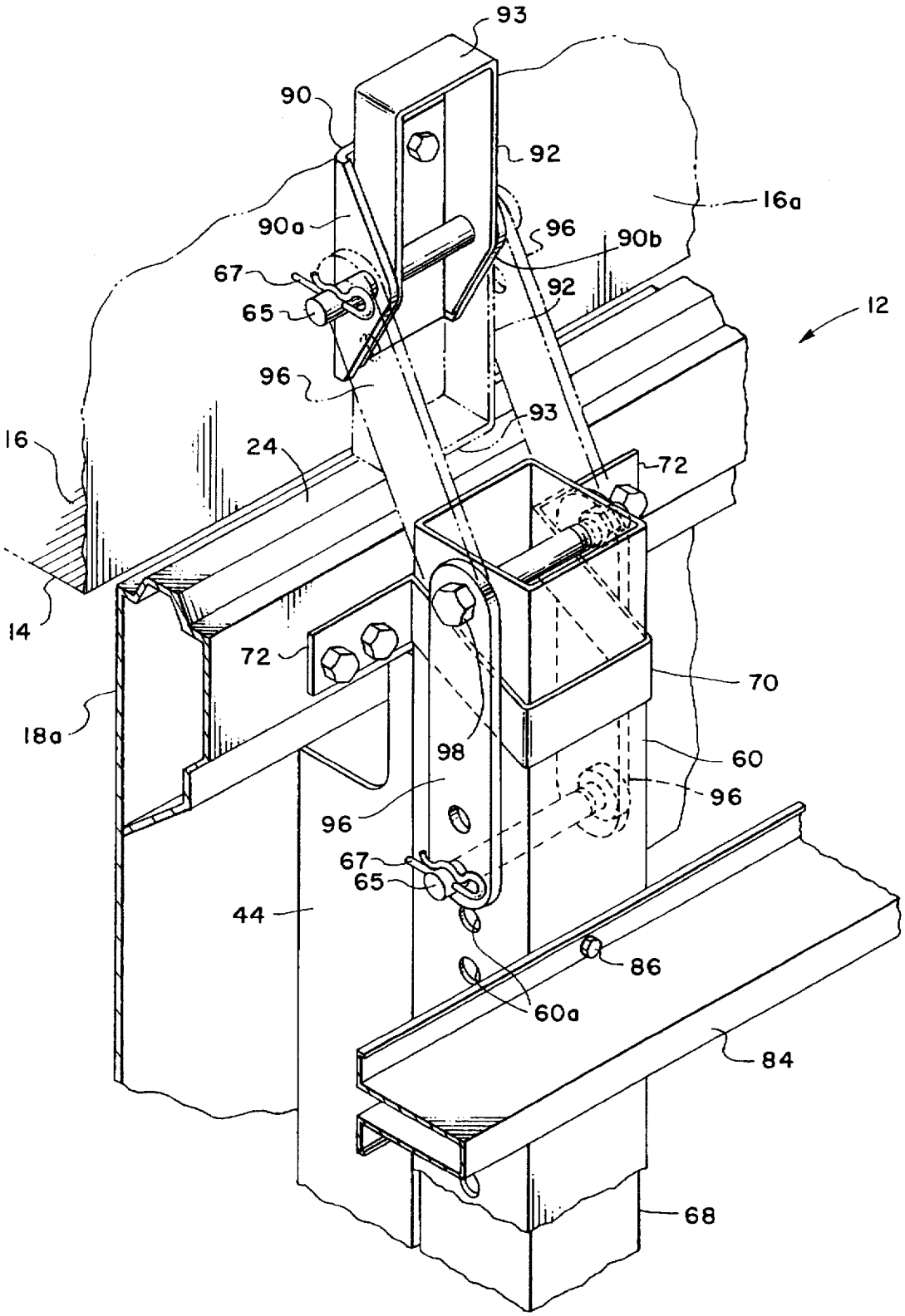
FIG. 5 is a detail perspective view of a wall mounted bracket and locking mechanism for engagement with the upper edge of the door.

Referring now to FIGS. 3 and 5, the door locking and reinforcing mechanism also includes a bracket 90 having opposed flanges 90*a* and 90*b*. The bracket 90 is preferably secured to the inner wall surface 16*a* of the building wall 16 in a position directly above the reinforcing pin receiving tube 60. The bracket 90 is positioned sufficiently from the upper edge 24 of the door section 18*a* as to allow clearance for the door 12 when it moves along the guidetracks 30 and 32 from a closed position toward an open position. However, when it is desired to lock the upper edge of the door 12 to prevent displacement away from the opening 14 or to prevent the tendency for the door to move upward along the guidetracks, a generally U-shaped retainer member 92 supported by the bracket 90 is moved to a working position wherein its base portion 93 is engageable with the upper longitudinal edge 24 of the panel 18*a*. This alternate working position of the bracket 92 is shown in FIG. 5. A retaining pin 65 and retainer 67 are operable to support the member 92 on the bracket 90 in both positions, that is the retracted position shown by the solid lines in FIG. 5 and the working position shown by the alternate position lines in FIG. 5.

Additionally, as shown in FIG. 5, the locking and reinforcement mechanism for door 12 includes a pair of opposed, elongated links 96 pivotally secured at one end to the upper end of the tube 60 by suitable fastener means 98. The links 96 are retained in a nonworking position secured to the tube 60 by a retaining pin 65 and removable hairpin retainer 67. However, when it is desired to secure the upper edge of the door 12 to the wall 16, the links 96 are swung from their nonworking position shown in FIG. 5 to a working position connected to the bracket 90 by way of its retaining pin 65, preferably after the member 92 has been repositioned to engage the upper edge 24 of door section 18*a*.

Figure 9:
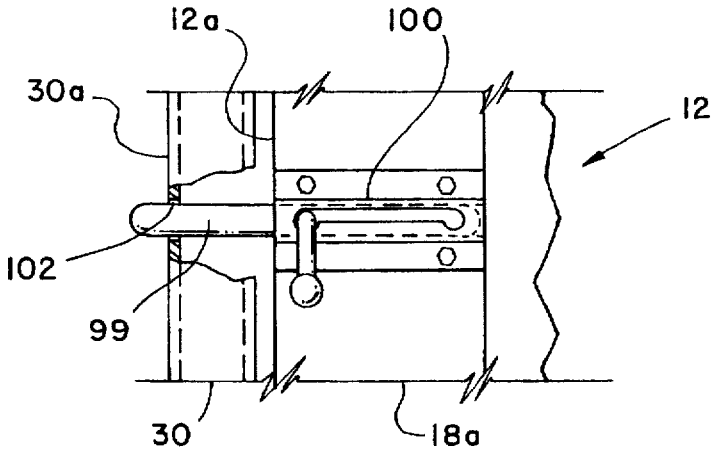
FIG. 9 is a detail view of a door mounted locking bolt engageable with one of the guidetracks.

Referring further to FIG. 1 and also FIG. 9, each lateral side 12*a* and 12*b* of door 12 is also, preferably, provided with a slidable bolt 99 which is supported on section 18*a* by a support member 100, see FIG. 9, by way of example. The bolts 99 are movable from a retracted position to an extended position projecting through opposed slots 102 formed in the tracks 30 and 32, one shown in FIG. 9, when the door 12 is in a closed position. The bolts 99 may be conventional door locking type slide bolts and at least one bolt and supporting member are provided on opposite sides of the door 12. Additional slide bolts, not shown, together with corresponding openings in the tracks 30 may also be provided, if desired. The bolts 99 may be used in place of or in addition to the retaining member 92.

Referring now to FIGS. 3 and 8, FIG. 3 shows the positions of the reinforcing pin or bolt members 68 and 69 in their retracted nonworking positions for normal operation of the door to move between its open and closed positions about the pivotal connections formed between each panel or section 18*a*, 18*b*, 18*c* and 18*d* and its adjacent section or sections. Thanks to the provision of the pin receiving and support tubes 60 and 62, the reinforcing pins 68 and 69 are conveniently stored on the door 12 out of sight and without interfering with normal operation of the door. Moreover, the pin 69 is supported in a retracted position to prevent engagement with the garage floor 17 and the retainer 92 and links 96 are disposed in their nonworking positions, respectively. The slide bolts 99 are also disposed in retracted positions away from engagement with the tracks 30 and 32. However, when the door 12 is in a closed position covering the opening 14 and wind loading on the door is likely to increase thereby causing a pressure differential across the face of the door in one direction or the other, the door may be locked and reinforced against unwanted displacement away from its opening 14 by removing the retaining pin 65 from each of the tubes 60 and 62 to allow the pins 68 to drop downwardly from their supporting tube partially into the adjacent tube 62 until the lower edges of the pins engage a stop, such as provided by the fasteners 86, respectively. The pins 68 are, of course, released for movement to a locking position by removing the retaining pins 65 from the respective tubes 60 and 62. The retaining pins 65 may be replaced in a set of openings 60*a* or 62*a* in the tube in connection with which the retaining pin 65 is being used. The anchor pin 69 is, of course, also allowed to drop into the opening 81 in the building floor 17 to prevent unwanted displacement of the lower edge of the door 12.

Lateral displacement of the upper edge of the door 12 and vertical movement of the door in its guidetracks are prevented by removing the retaining pins 65 supporting the member 92 in its retracted, nonworking position and retaining the links 96 in their nonworking positions, repositioning the member 92 so that its transverse base 93 is engageable with the upper edge 24 of the door section 18*a*, swinging the links 96 into a working position for engagement with the anchor bracket 90 and replacing the pin 65 in the anchor bracket 90 connected to the links 96 and the member 92. The other retaining pin 65 may be replaced in one or more sets of holes 60*a* in the tube 60 when not needed for other purposes. Accordingly, as shown in FIG. 8, the door is now locked and reinforced against substantial wind loads imposed thereon to prevent unwanted hinging action of the sections 18*a*, 18*b*, 18*c* and 18*d* relative to each other and movement of the door with respect to the floor 17 or the building wall 16.

When adverse weather conditions have subsided or the door 12 is otherwise to be readied for operation, the links 96 and the retaining member 92 are restored to their nonworking positions, the reinforcing pins 68 are pushed upwardly into their receiving and support tubes 60 and 62, respectively, and the respective retaining pins 65 for each pin 68 and 69 is replaced in each tube to the positions shown in FIG. 3 for retaining the pins 68 and 69 in their respective nonworking positions. The bolts 99 are also retracted to a nonworking position out of engagement with the openings formed in their respective tracks 30 and 32.

Figure 10:
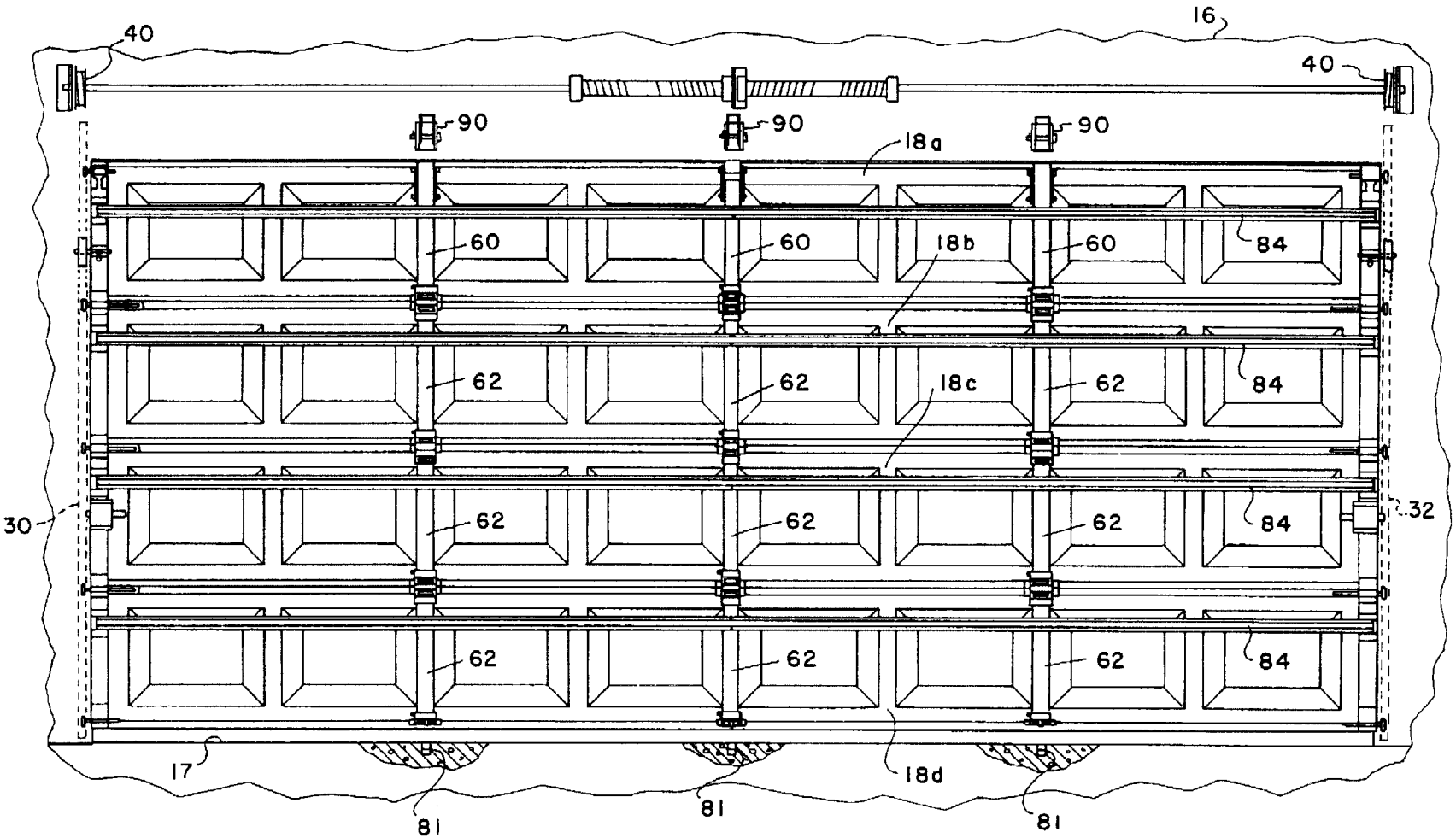
FIG. 10 is a rear elevation of a sectional door showing an arrangement of three spaced apart locking and reinforcing mechanisms in accordance with the invention mounted thereon.

Referring now to FIG. 10, the door locking and reinforcing mechanism just described may be provided in plural units for particularly wide doors or to withstand extreme wind loads such as might be generated by hurricanes or typhoons. In FIG. 10, the door 12 is provided with three spaced apart locking and reinforcing mechanisms comprising respective sets of tubes 60 and 62 suitably secured to each of the door sections 18*a*, 18*b*, 18*c* and 18*d* at the respective spaced apart vertically extending stiles 44 for each of the sections. Each set of vertically aligned pin receiving tubes 60 and 62 is suitably secured to the aligned stiles 44, or similar members, in the same manner as described above for the embodiment of the invention shown in conjunction with FIGS. 1 through 9. Of course, different configurations of sectional doors may require different numbers of sets of reinforcing tubes 60 and 62 and their associated reinforcing pins.

An important advantage of the door locking and reinforcing mechanism of the invention resides in the configuration of the mechanism wherein it may be furnished as a kit for retrofitting existing garage doors. As long as a sectional door has or can be provided with suitable surfaces on each of the hinged door sections on which the locking pin or bolt receiving and support tubes 60 and 62 may be mounted aligned with each other to receive a reinforcing pin from an adjacent tube, the reinforcing mechanism described may be mounted on the door and operated in the same manner described herein to prevent unwanted collapse or displacement of the door away from the opening that it is intended to cover. Moreover, those skilled in the art will also appreciate that the door locking and reinforcing mechanism described above may be used as additional security for retaining the door in a closed and locked position against unwanted movement for any reason.

The door locking and reinforcing mechanism described above may be fabricated using conventional engineering materials. For example, the tubes 60 and 62 may be fabricated from conventional square cross section steel tubing having at least a 60,000 psi yield strength and a nominal cross section dimension of 2.50 inches square. In like manner, the reinforcing pins or bolts 68 may be formed of suitable steel, square cross section tubing as described above, but having a nominal cross sectional dimension of 2.25 inches to allow the pins to be telescopically slidably fitted in their respective support tubes. By making the pins or bolts 68 of lightweight tubing having a suitable cross sectional configuration, the total weight of the locking and reinforcing mechanism is minimized without a concurrent loss of strength. The remaining components of the locking and reinforcing mechanism just described may also be fabricated using conventional engineering materials and methods for miscellaneous hardware items such as brackets, and retaining members, such as hairpin cotter pins and the like, and similar conventional structural elements.

Although preferred embodiments of the invention have been described in detail herein, those skilled in the art will recognize that various substitutions and modifications may be made to the invention without departing from the scope and spirit of the appended claims.

What is claimed is:

1. In a sectional upward acting door for covering an opening in a building, said door having a plurality of elongated sections each including spaced apart longitudinal edges, respectively, said elongated sections being interconnected by hinge means to provide at least limited pivotal movement between adjacent sections for moving said door between open and closed positions, a mechanism for locking and reinforcing said door in a closed position to prevent pivotal movement of said sections relative to each other, said mechanism comprising:

a plurality of aligned pin receiving members disposed on said sections, respectively, and comprising elongated continuous tubes extending substantially between said edges of each of said sections from one said edge to another, respectively, said pin receiving members being adapted to support reinforcing pins extending therebetween, respectively, to prevent pivotal movement of said sections relative to each other;

elongated tubular door reinforcing pins slidably disposed in respective ones of said pin receiving members for retention within said pin receiving members, said reinforcing pins being movable to positions to extend between and within adjacent ones of said pin receiving members to lock said door in a substantially planar position; and means for retaining said reinforcing pins in said pin receiving members, respectively, out of engagement with an adjacent pin receiving member.

2. The door set forth in claim 1 wherein:

at least one of said reinforcing pins is adapted to engage a recess formed in a floor of said building for locking a lower edge of said door in a position to prevent generally lateral displacement of said door across said floor.

3. The door set forth in claim 1 wherein:

said means for retaining said reinforcing pins comprise retaining pins removably disposed in said pin receiving members for retaining said reinforcing pins in retracted positions within said pin receiving members, respectively.

4. The door set forth in claim 1 including:

a bracket operable to be disposed on a wall adjacent said opening and link means supported on one of said bracket and said door for interconnecting said bracket with said door to prevent displacement of said door away from said opening.

5. The door set forth in claim 1 including:

a bracket supported on a wall adjacent said opening; and retainer means supported on said bracket and engageable with a longitudinal top edge of said door to prevent vertical movement of said door from a closed position toward an open position.

6. The door set forth in claim 1 including:

sliding bolt means disposed on said door adjacent at least one side edge of said door and movable from a retracted position to a working position engageable with support means for said door to prevent movement of said door with respect to said support means.

7. The door set forth in claim 1 including:

spaced apart bracket means for securing said pin receiving members to said door, respectively.

8. The door set forth in claim 1 wherein:

said door includes surface means engageable with cooperating surface means on said pin receiving members and said pin receiving members are secured to said surface means on said door by an adhesive, respectively.

9. A locking and reinforcing mechanism for a sectional upward acting door, said door being made up of a plurality of elongated sections which are hinged to each other to provide pivotal movement of said sections when moving said door between open and closed positions, said mechanism comprising:

a plurality of elongated pin receiving members, comprising continuous square cross section tubes, respectively, said pin receiving members being adapted to be supported on said sections of said door, respectively, and aligned with each other;

means for securing said pin receiving members to said door;

a plurality of elongated reinforcing pins, each of said reinforcing pins comprising a square cross section tube operable to be slidably disposed in adjacent ones of said pin receiving members and extendable between adjacent door sections when said pin receiving members are mounted on said sections, respectively, to substantially prevent said sections from moving relative to each other; and means for retaining said reinforcing pins in respective ones of said pin receiving members in a retracted position out of engagement with said adjacent ones of said pin receiving members to provide for pivotal movement of said door sections relative to each other.

10. The mechanism set forth in claim 9 including:

a bracket operable to be supported on a wall adjacent said door; and a retainer adapted to be supported on said bracket and movable between a nonworking position and a working position engageable with a lateral top edge of said door to prevent movement of said door toward an open position.

11. The mechanism set forth in claim 9 including:

a bracket operable to be supported on a wall adjacent said door; and link means operable to be engaged with said bracket and with one of said pin receiving members for retaining said door against lateral displacement away from said wall.

12. In a sectional upward acting door for covering an opening in a building, said door having a plurality of elongated door sections interconnected by hinge means, respectively, to provide at least limited pivotal movement between adjacent ones of said sections for moving said door between open and closed positions, means for reinforcing said door in a closed position to prevent movement of said sections relative to each other, said means comprising:

a plurality of elongated tubular pin receiving members disposed on adjacent ones of said sections, respectively, and aligned with each other, vertically, when said door is in a closed position, said means for reinforcing including a locking and reinforcing pin operable to be slidably disposed within a respective pin receiving member in a retracted position to permit movement of said door between an open and closed position with respect to said opening, said reinforcing pins being slidably movable to extend between adjacent door sections, respectively, and engaged with the pin receiving members of said adjacent sections to form a substantially rigid connection between said sections to prevent relative movement therebetween; and means for retaining said reinforcing pins in said pin receiving members, comprising plural retaining pins disposed in said pin receiving members and engaged with said reinforcing pins for retaining respective ones of said reinforcing pins in retracted positions within said pin receiving members, respectively, said retaining pins being removable from engagement with said reinforcing pins, respectively, to permit said reinforcing pins to move to positions extending between adjacent ones of said pin receiving members.

13. In a sectional upward acting door for covering an opening in a building, said door having a plurality of elongated sections interconnected by hinge means to provide at least limited pivotal movement between adjacent ones of said sections for moving said door between open and closed positions, means for locking and reinforcing said door in a closed position to prevent unwanted movement of said sections relative to each other, said means comprising:

a plurality of elongated generaly square cross section tubular receiving members supported on each of said sections and aligned with each other substantially vertically when said door is in a closed position;

a plurality of elongated generally square cross section tubular reinforcing pins slidably disposed in respective ones of said receiving members and operable to be moved from a nonworking position disposed in each of said receiving members, respectively, to a working position extending between adjacent ones of said receiving members to prevent movement of said sections relative to each other;

respective retaining pins engageable with said reinforcing pins and said receiving members to retain said reinforcing pins in retracted non-working positions within each of said receiving members, respectively; and means for supporting said reinforcing pins extending between and within adjacent ones of said receiving members for reinforcing said door against movement of said sections relative to each other.

* * * * *